US007566688B2

(12) United States Patent
Tanaka et al.

(10) Patent No.: US 7,566,688 B2
(45) Date of Patent: Jul. 28, 2009

(54) DETERGENT COMPOSITION

(75) Inventors: Atsushi Tanaka, Wakayama (JP); Satoru Kijima, Wakayama (JP); Makoto Kubo, Wakayama (JP)

(73) Assignee: Kao Corporation, Tokyo (JP)

( * ) Notice: Subject to any disclaimer, the term of this patent is extended or adjusted under 35 U.S.C. 154(b) by 339 days.

(21) Appl. No.: 10/539,052

(22) PCT Filed: Dec. 9, 2003

(86) PCT No.: PCT/JP03/15729

§ 371 (c)(1), (2), (4) Date: Feb. 13, 2006

(87) PCT Pub. No.: WO2004/055146

PCT Pub. Date: Jul. 1, 2004

(65) Prior Publication Data

US 2006/0252665 A1 Nov. 9, 2006

(30) Foreign Application Priority Data

Dec. 16, 2002 (JP) ..... 2002-363672

(51) Int. Cl.
*C11D 3/00* (2006.01)

(52) U.S. Cl. ..... 510/299; 510/506; 510/400; 510/276; 510/499; 510/528; 430/444

(58) Field of Classification Search ..... 510/299, 510/400, 506; 430/444
See application file for complete search history.

(56) References Cited

U.S. PATENT DOCUMENTS

| | | | | |
|---|---|---|---|---|
| 3,416,952 | A | 12/1968 | McIntyre et al. | |
| 3,523,797 | A * | 8/1970 | Willems et al. | 430/444 |
| 3,557,039 | A | 1/1971 | McIntyre et al. | |
| 3,746,545 | A | 7/1973 | Pollet et al. | |
| 4,086,279 | A * | 4/1978 | Langdon et al. | 568/623 |
| 4,795,584 | A | 1/1989 | Ross et al. | |
| 5,298,570 | A * | 3/1994 | Tahara et al. | 525/329.7 |
| 5,877,245 | A * | 3/1999 | Wiggins et al. | 524/366 |
| 6,071,871 | A | 6/2000 | Gosselink et al. | |
| 6,083,898 | A | 7/2000 | Meixner et al. | |
| 6,165,970 | A * | 12/2000 | Williams (nee Mac Beath) et al. | 510/480 |
| 6,514,927 | B2 * | 2/2003 | Lang et al. | 510/357 |
| 6,897,193 | B2 * | 5/2005 | Kischkel et al. | 510/475 |
| 2007/0225185 | A1 * | 9/2007 | Kasai | 510/170 |
| 2008/0194449 | A1 * | 8/2008 | Becker et al. | 510/299 |
| 2009/0007936 | A1 * | 1/2009 | Uhl et al. | 134/6 |

FOREIGN PATENT DOCUMENTS

| | | | |
|---|---|---|---|
| JP | 9-31394 | A | 2/1997 |
| JP | 11-508319 | A | 7/1999 |
| JP | 2001-502735 | A | 2/2001 |
| JP | 2002-536534 | A | 10/2002 |
| JP | 2003-253197 | A | 9/2003 |
| WO | WO-97/42285 | A1 | 11/1997 |
| WO | WO-98/15607 | A2 | 4/1998 |
| WO | WO-00/47704 | A1 | 8/2000 |
| WO | WO-01/09223 | A1 | 2/2004 |

* cited by examiner

*Primary Examiner*—Mark Eashoo
*Assistant Examiner*—Jane L Stanley
(74) *Attorney, Agent, or Firm*—Birch, Stewart, Kolasch & Birch, LLP

(57) ABSTRACT

The invention provides a soil release agent and a detergent composition blended therewith. The invention relates to a crosslinked product obtained by reacting a compound having 2 to 32 hydroxyl groups, such as triethanol amine, with a compound having at least two functional groups reacting with hydroxyl groups, such as (poly)ethylene glycol diglycidyl ether, a soil release agent containing the crosslinked product, and a detergent composition containing the soil release agent.

4 Claims, No Drawings

DETERGENT COMPOSITION

FIELD OF THE INVENTION

The present invention relates to a detergent composition containing a crosslinked product.

BACKGROUND OF THE INVENTION

Adsorption of a base material into fibers is conducted to facilitate release of soil components from the fibers at the time of washing. When soil components are easily released from fibers at the time of washing, an extremely excellent washing effect can be brought about as compared with a usual washing method. Such effect is called a soil release effect, and the base material exhibiting this effect is generally called a soil release agent.

With respect to the soil release agent, several findings have been obtained, and for example, Japanese Patent Application National Publication (Laid-Open) No. 2001-502735 discloses a soil release agent containing a crosslinked, nitrogen-containing compound obtained by crosslinking a compound having at least 3 NH groups with a bi- or more (poly) functional crosslinking agent reacting with NH groups, and Japanese Patent Application National Publication (Laid-Open) No. 11-508319 discloses a soil release agent containing a modified polyamine compound. These soil release agents exhibit an excellent effect on hydrophilic cotton fibers, but cannot give a sufficient effect on hydrophobic synthetic fibers such as polyester.

On one hand, a compound based on terephthalate is known to be effective as a soil release agent for hydrophobic synthetic fibers such as polyester textile blend cloth etc. (U.S. Pat. Nos. 3,416,952, 3,557,039, and 4,795,584). However, these soil release agents do not exhibit a sufficient effect on comparatively hydrophilic cotton fibers.

U.S. Pat. No. B 6,083,898 discloses a crosslinked product of polyethylene imine and polyethylene glycol diglycidyl ether. U.S. Pat. No. B 6,071,871 discloses a polyoxyalkylene adduct, quaternarized product and betaine compound of a crosslinked product of polyethylene imine and polyethylene glycol diglycidyl ether.

As described above, a soil release agent capable of exhibiting an effect on both hydrophilic fibers such as cotton and hydrophobic fibers such as polyester has never been found.

SUMMARY OF THE INVENTION

The present invention relates to a crosslinked product obtained by reacting a compound having 2 to 32 hydroxyl groups (hereinafter, referred to as component (a)) with a compound having at least two functional groups reacting with hydroxyl groups (hereinafter, referred to as component (b)), use of the crosslinked product as a soil releasing agent, a soil release agent containing the crosslinked product, and a detergent composition containing the soil release agent.

The present invention also provides a detergent composition containing a detergent and a crosslinked product obtained by reacting a compound having 2 to 32 hydroxyl groups (hereinafter, referred to as component (a)) with a compound having at least two functional groups reacting with hydroxyl groups (hereinafter, referred to as component (b)).

The present invention also provides a method of releasing soil from an object of washing by the crosslinked product. For example, the invention provides a method of releasing soil from clothes by the crosslinked product. The invention also provides use of the crosslinked product as a soil release agent.

DETAILED DESCRIPTION OF THE INVENTION

The present invention relates to a soil release agent effective for both hydrophilic fibers such as cotton and hydrophobic fibers such as polyester, as well as a detergent composition containing the same.

[Crosslinked Product]

The component (a) constituting the crosslinked product of the present invention is a compound having 2 to 32 hydroxyl groups, preferably a compound having 2 to 10 hydroxyl groups.

The component (a) is selected preferably from the following compounds:

Compounds represented by formula (I):

$$HO—(R^1O)_m—H \quad (I)$$

wherein $R^1$ is a C2 to C3 alkylene group, m is a number of 1 to 30, preferably 1 to 20, more preferably 1 to 10, still more preferably 1 to 5; and Compounds represented by formula (II):

$$HO—R^2—NX—R^3—OH \quad (II)$$

wherein $R^2$ and $R^3$ independently represent a C2 to C3 alkylene group, X represents a hydrogen atom or a group represented by —$R^4$—OH whereupon $R^4$ represents a C2 to C3 alkylene group, and $R^2$, $R^3$ and $R^4$ may contain repeated oxyethylene groups and/or oxypropylene groups.

For example, the compounds represented by formula (II) include compounds represented by the following formula (IV):

$$HO\text{-}(A^1O)_k—NX\text{-}(A^2O)_l—OH \quad (IV)$$

wherein $A^1$ and $A^2$ independently represent a C2 to C3 alkylene group, X represents a hydrogen atom or -$(A^3O)_j$—OH ($A^3$ is a C2 to C3 alkylene group), and j, k and l independently represent 1 to 10, preferably 1 to 5, more preferably 1 to 2, glycerin, polyglycerin having a polymerization degree of 1 to 30, and sorbitol.

The component (a) is preferably a compound of formula (II) wherein $R^2$ and $R^3$ each represent a C2 to C3 alkylene group, and X represents a group represented by —$R^4$—OH whereupon $R^4$ represents a C2 to C3 alkylene group; glycerin; polyglycerin having a polymerization degree of preferably 1 to 10, more preferably 1 to 5, still more preferably 1 to 2; or sorbitol, most preferably triethanol amine.

The component (b) is a compound having at least 2, preferably 2 to 32, functional groups reacting with hydroxyl groups, and is further preferably polyhydric alcohol polyglycidyl ether.

The polyhydric alcohol includes a compound represented by formula (III):

$$HO—(R^5O)_n—H \quad (III)$$

wherein $R^5$ represents a C2 to C3 alkylene group, and n is a number of 1 to 30, preferably 1 to 25, more preferably 1 to 20, still more preferably 1 to 15; glycerin; polyglycerin having a polymerization degree of 1 to 30; and sorbitol, and in particular the polyhydric alcohol is preferably ethylene glycol and polyethylene glycol (hereinafter referred to collectively as (poly) ethylene glycol) represented by formula (III) wherein $R^5$ is an ethylene group and n is 1 to 30, preferably 1 to 20; glycerin; polyglycerin having a polymerization degree of 2 to 10; or sorbitol, more preferably (poly) ethylene glycol.

The component (b) is particularly preferably (poly)ethylene glycol diglycidyl ether.

The components (a) and (b) can be easily produced by dropping the component (b) into the component (a) or charging the two all at once, in the temperature range of 0 to 200° C., preferably 30 to 120° C., by using a lower tertiary amine, for example dimethyl octyl amine or the like, as a catalyst. In this case, the viscosity in the system is significantly increased as the reaction proceeds, but the reaction mixture can be easily handled by dissolution or dilution and dispersion with water or another non-polar or polar solvent. The reaction molar ratio of the component (a) to component (b) [that is, (a)/(b)] is preferably 1/0.1 to 1/1, more preferably 1/0.2 to 1/1, still more preferably 1/0.4 to 1/0.8.

The viscosity of the crosslinked product of the present invention in the form of 10 wt % aqueous solution is preferably 5 to 10,000 mPa·s, more preferably 7 to 2,000 mPa·s. This viscosity is a value measured at room temperature (25° C.) by a Brookfield viscometer (manufactured by Toki Sangyo Co., Ltd.).

[Soil Release Agent]

By the soil release agent of the present invention, soil is washed off at the time of washing clothes, and simultaneously a soil release effect is given upon adsorption thereof into clothes. For example, when a cloth of cotton fibers or polyester fibers is washed, a soil release agent consisting of the crosslinked product of the present invention is added to a detergent etc. and used in washing, whereby the soil release agent can be adsorbed into the surfaces of the fibers to confer a soil release effect. That is, the soil release effect is given to the clothes to exhibit a high detergent effect by repeating a usual washing cycle that involves dipping or washing the clothes for about 3 minutes to 2 hours in a washing machine or by hand washing, then rinsing the clothes sufficiently with water, dehydrating and drying them. The dipping or washing time is preferably 5 minutes to 1 hour, more preferably 8 minutes to 20 minutes. As the washing is conducted more times, a further excellent soil release effect can be obtained.

The soil release agent of the present invention can be applied not only to a detergent but also to a fiber treating agent such as a softener or a bleaching agent, and can be incorporated as necessary to confer a soil release effect.

[Detergent Composition]

The detergent composition of the present invention contains the soil release agent of the present invention described above. The content of the soil release agent in the composition of the present invention is preferably 0.01 to 50 wt %, more preferably 0.05 to 20 wt %, still more preferably 1.0 to 10 wt %.

Preferably, the detergent composition of the present invention further contains a surfactant. The surfactant includes a nonionic surfactant, an anionic surfactant, an amphoteric surfactant and a cationic surfactant. When the surfactant is used in combination with the soil release agent of the present invention, the soil release effect is amplified.

The nonionic surfactant used in the present invention is preferably polyoxyethylene alkyl ether wherein the number of carbon atoms in the alkyl group of the polyoxyethylene alkyl ether is preferably 10 to 20, more preferably 12 to 18, still more preferably 12 to 14, and the number of ethylene oxide units added on average is preferably 4 to 16, more preferably 4 to 14, still more preferably 5 to 12. The nonionic surfactant includes alkyl benzene sulfonates, alkyl or alkenyl sulfates, polyoxyalkylene alkyl or alkenyl ether sulfates, alkane sulfonates, fatty acid salts, polyoxy alkylene alkyl or alkenyl ether carboxylates, α-sulfofatty acid salts or ester salts, amino acid-based surfactants, N-acyl amino acid-based surfactants etc., among which the alkyl benzene sulfonates and the alkyl or alkenyl sulfates are preferable, and the alkyl benzene sulfonates are particularly preferable. The counterion of the anionic surfactant includes alkali metal, ammonium, alkanol amine etc. The amphoteric surfactant includes alkyl dimethyl aminoacetic acid betaine, fatty acid amide propyl betaine, etc. The cationic surfactant includes quaternary ammonium salts etc. The anionic surfactant and/or the nonionic surfactant can also be used in combination with the amphoteric surfactant and/or the cationic surfactant.

In respect of detergency, the content of the surfactant in the detergent composition of the present invention is preferably 0.1 to 40 wt %, more preferably 5 to 35 wt %, still more preferably 10 to 30 wt %.

Preferably, the detergent composition of the present invention further contains a polycarboxylic acid-based polymer compound. The polycarboxylic acid-based polymer compound includes polyacrylic acid and an acrylic acid/maleic acid copolymer, and salts thereof, and these are generally used as calcium scavengers and dispersants in detergents. Further, a polysaccharide with carboxylic acids, or a glyoxylic acid polymer can also be used. The average molecular weight of the polycarboxylic acid-based polymer compound is preferably 8,000 to 100,000, more preferably 10,000 to 70,000.

The polycarboxylic acid-based polymer compound is used in combination with the crosslinked product of the present invention thereby promoting dispersibility in a detergent solution, to assist efficient adsorption of the soil release agent into fibers. In respect of detergency, the content of the polycarboxylic acid-based polymer compound in the detergent composition of the present invention is preferably 0.01 to 50 wt %, more preferably 0.05 to 20 wt %, still more preferably 1.0 to 10 wt %.

The detergent composition of the present invention can be blended if necessary with zeolite (crystalline aluminosilicate), a divalent-metal-ion scavenger (other than the polycarboxylic acid-based polymer compound) such as a chelating agent, an alkali component such as potassium carbonate, sodium carbonate, sodium bicarbonate, sodium silicate etc., an enzyme component such as protease, amylase, cellulase, lipase, pectinase etc., a bleaching agent such as sodium percarbonate, sodium perborate etc., a peroxide stabilizer such as magnesium silicate etc., a re-contamination inhibitor such as polyvinyl pyrrolidone etc., sulfites, a fluorescent dye, a pigment, a caking inhibitor, a solubilizer, a perfume etc.

EXAMPLES

In the Examples, "%" is "wt %" unless otherwise specified. The oxysilane values in the Examples were measured by the following method, and the viscosity was measured at room temperature (25° C.) by a Brookfield viscometer (manufactured by Toki Sangyo Co., Ltd.).

<Method of Measuring Oxysilane Value>

The oxysilane value, which is expressed in terns of the amount (mg) of potassium hydroxide used in titration of hydrochloric acid consumed to convert 1 g of a sample into the corresponding chlorohydrin, was determined by reacting hydrochloric acid with the sample at 120 to 130° C. for 30 minutes and subsequent titration with potassium hydroxide using phenolphthalein as an indicator.

Production Example 1

A 1000-ml flat-bottom separable flask equipped with a stirring blade, a thermometer and a condenser was charged with 100 g triethanol amine (MW 149) and dimethyl octyl amine in an amount of 2 mol-% based on the triethanol amine, and the mixture was heated to 50° C. Then, 70 g ethylene glycol diglycidyl ether (MW 174) was dropped thereto such that the temperature could be kept at 50° C. On this occasion, the molar ratio of ethylene glycol diglycidyl ether to triethanol amine was 0.6. After the dropping was finished, the reaction was continued until the viscosity of the reaction product was increased to make stirring difficult. The oxysilane value in this stage indicated 3 or less. Thereafter, the reaction mixture was diluted to 10% with deionized water by means of a homomixer. The resulting crosslinked product exhibited water solubility and indicated an oxysilane value of 1 or less in this stage, and its epoxy groups nearly disappeared. The viscosity of the resulting aqueous crosslinked product solution was 7.8 mPa·s.

Production Example 2

The same reaction container as in Production Example 1 was charged with 100 g triethanol amine and dimethyl octyl amine in an amount of 2 mol-% based on the triethanol amine, and the mixture was heated to 50° C. Then, 82 g ethylene glycol diglycidyl ether was dropped thereto such that the temperature could be kept at 50° C. On this occasion, the molar ratio of ethylene glycol diglycidyl ether to triethanol amine was 0.7. After the dropping was finished, the reaction was continued until the viscosity of the reaction product was increased to make stirring difficult. Thereafter, the reaction mixture was diluted to 10% with deionized water under stirring with a homomixer. The resulting crosslinked product indicated a stable dispersion and indicated an oxysilane value of 1 or less in this stage, and its epoxy groups nearly disappeared. The viscosity of the resulting crosslinked product dispersion was 27.1 mPa·s.

Production Example 3

The same reaction container as in Production Example 1 was charged with 100 g triethanol amine and dimethyl octyl amine in an amount of 2 mol-% based on the triethanol amine, and the mixture was heated to 90° C. Then, 82 g ethylene glycol diglycidyl ether was dropped thereto such that the temperature could be kept at 90° C. On this occasion, the molar ratio of ethylene glycol diglycidyl ether to triethanol amine was 0.7. After the dropping was finished, the reaction was carried out for 4 hours. In this stage, the oxysilane value indicated 3 or less. Thereafter, the reaction mixture was diluted to 10% with deionized water by means of a homomixer. The resulting crosslinked product was water-soluble and indicated an oxysilane value of 1 or less in this stage, and its epoxy groups nearly disappeared. The viscosity of the resulting aqueous crosslinked product solution was 5.1 mPa·s.

Production Example 4

The same reaction container as in Production Example 1 was charged with 50 g triethanol amine and dimethyl octyl amine in an amount of 2 mol % based on the triethanol amine, and the mixture was heated to 50° C. Then, 106 g polyethylene glycol diglycidyl ether (MW 526, manufactured by ALDRICH) was dropped thereto such that the temperature could be kept at 50° C. On this occasion, the molar ratio of polyethylene glycol diglycidyl ether to triethanol amine was 0.6. After the dropping was finished, the reaction was continued until the viscosity of the reaction product was increased to make stirring difficult. Thereafter, the reaction mixture was diluted to 5% with deionized water by means of a homomixer. The resulting crosslinked product was water-soluble and indicated an oxysilane value of 1 or less in this stage, and its epoxy groups nearly disappeared. The viscosity of the resulting aqueous crosslinked product solution was 198 mPa·s.

Production Example 5

The same reaction container as in Production Example 1 was charged with 50 g glycerin and dimethyl octyl amine in an amount of 2 mol-% based on the glycerin, and the mixture was heated to 90° C. Then, 82 g ethylene glycol diglycidyl ether was dropped thereto such that the temperature could be kept at 90° C. On this occasion, the molar ratio of ethylene glycol diglycidyl ether to glycerin was 0.7. After the dropping was finished, the reaction was carried out for 10 hours. In this stage, the oxysilane value indicated 3 or less. Thereafter, the reaction mixture was diluted to 10% with deionized water by means of a homomixer. The resulting crosslinked product was water-soluble and indicated an oxysilane value of 1 or less in this stage, and its epoxy groups nearly disappeared. The viscosity of the resulting aqueous crosslinked product solution was 5.3 mPa·s.

Production Example 6

The same reaction container as in Production Example 1 was charged with 50 g triethanol amine and dimethyl octyl amine in an amount of 2 mol-% based on the triethanol amine, and the mixture was heated to 70° C. Then, sorbitol polyglycidyl ether was dropped thereto such that the temperature could be kept at 70° C. On this occasion, the molar ratio of sorbitol polyglycidyl ether (manufactured by Nagase Kasei) to triethanol amine was 0.1. After the dropping was finished, the reaction was carried out for 3 hours. Thereafter, the reaction mixture was diluted to 10% with deionized water by means of a homomixer. The resulting crosslinked product was water-soluble and indicated an oxysilane value of 1 or less in this stage, and its epoxy groups nearly disappeared. The viscosity of the resulting aqueous crosslinked product solution was 6.4 mPa·s.

Example 1

The crosslinked products obtained in Production Examples 1 to 6 were used to prepare detergent compositions having the compositions shown in Table 1. These detergent compositions were evaluated for detergency towards sebaceous matter. The results are shown in Table 1.

<Method of Evaluating Detergency>

(1) Repeated Washing of Cotton Fiber Clothes and Polyester Fiber Clothes and Formation of Soiled Clothes Each of the detergent compositions shown in Table 1 was dissolved in 4° DH hard water to prepare 0.06% aqueous detergent solution, and then adjusted to pH 10.5 with NaOH. Five cotton clothes of 10 cm×10 cm were introduced into the aqueous detergent solution, stirred and washed at 20° C. for 10 minutes at 100 rpm in Tergotometer. After rinsing with running water, the clothes were dehydrated sufficiently in a centrifuging dehydrator, and then dried for 1 hour or more in a room at 25° C., 50% RH. This washing treatment was conducted repeatedly 3 times, and then a model for sebaceous matter containing 0.02% carbon black added to 100% mixture consisting of 60% cottonseed oil, 10% cholesterol, 10% oleic acid, 10% palmitic acid and 10% solid paraffin was applied in an amount of 2 g every 10×10 cm area of the cotton clothes after the washing treatment, whereby soiled clothes contaminated with sebaceous matter were prepared.

With respect to polyester fiber clothes, 5 clothes (10×10 cm) were subjected to washing treatment in the same manner as for the cotton clothes, and then dried to prepare soiled clothes contaminated with sebaceous matter.

(2) Washing Conditions, Washing Method and Evaluation Method

Comparative Product 1, that is, a detergent composition shown in Table 1, was dissolved in 4° DH hard water to prepare 0.06% aqueous detergent solution, and then adjusted to pH 10.5 with NaOH. The 5 soiled cotton clothes or 5 soiled polyester clothes treated with each of the detergent compositions described above were placed in the aqueous detergent solution, stirred and washed at 20° C. for 10 minutes at 100 rpm in Tergotometer. After rinsing with running water, the clothes were pressed with an iron.

Then, the raw clothes before washing, the soiled clothes prepared after repeated washing, and the soiled clothes after final washing were measured for their reflectance at 460 nm with an autographic recording colorimeter (Shimadzu Corporation), and the sebaceous matter-washing degree (%) was calculated according to the following equation, and the average washing degree of the 5 soiled clothes was indicated.

Washing degree (%)=[(reflectance after final washing−reflectance after preparation of the soiled clothes)/(reflectance of the raw clothes−reflectance of the soiled clothes after preparation)]×100.

TABLE 1

| | | Product of the invention | | | | | | | | Comparative product | | |
|---|---|---|---|---|---|---|---|---|---|---|---|---|
| | | 1 | 2 | 3 | 4 | 5 | 6 | 7 | 8 | 1 | 2 | 3 |
| Formulation component (%) | Compound 1 | 0.5 | 5 | 10 | | | | | | | | |
| | Compound 2 | | | | 5 | | | | | | | |
| | Compound 3 | | | | | 5 | | | | | | |
| | Compound 4 | | | | | | 5 | | | | | |
| | Compound 5 | | | | | | | 5 | | | | |
| | Compound 6 | | | | | | | | 5 | | | |
| | Compound 7 | | | | | | | | | | 5 | 10 |
| | LAS | 20 | 20 | 20 | 20 | 20 | 20 | 20 | 20 | 20 | 20 | 20 |
| | AE | 5 | 5 | 5 | 5 | 5 | 5 | 5 | 5 | 5 | 5 | 5 |
| | Na polyacrylate | 2.5 | 2.5 | 2.5 | 2.5 | 2.5 | 2.5 | 2.5 | 2.5 | 2.5 | 2.5 | 2.5 |
| | AM | 2.5 | 2.5 | 2.5 | 2.5 | 2.5 | 2.5 | 2.5 | 2.5 | 2.5 | 2.5 | 2.5 |
| | PEG | 5 | 5 | 5 | 5 | 5 | 5 | 5 | 5 | 5 | 5 | 5 |
| | Sodium sulfite | 1 | 1 | 1 | 1 | 1 | 1 | 1 | 1 | 1 | 1 | 1 |
| | Potassium carbonate | 4 | 4 | 4 | 4 | 4 | 4 | 4 | 4 | 4 | 4 | 4 |
| | Sodium carbonate | 15 | 15 | 15 | 15 | 15 | 15 | 15 | 15 | 15 | 15 | 15 |
| | Sodium silicate | 10 | 10 | 10 | 10 | 10 | 10 | 10 | 10 | 10 | 10 | 10 |
| | Zeolite | 20 | 20 | 20 | 20 | 20 | 20 | 20 | 20 | 20 | 20 | 20 |
| | Fluorescent component | 0.01 | 0.01 | 0.01 | 0.01 | 0.01 | 0.01 | 0.01 | 0.01 | 0.01 | 0.01 | 0.01 |
| | Enzyme component | 0.04 | 0.04 | 0.04 | 0.04 | 0.04 | 0.04 | 0.04 | 0.04 | 0.04 | 0.04 | 0.04 |
| | Sodium sulfate | Balance (amount to make 100% in total) | | | | | | | | | | |
| Washing degree of the soiled polyester clothes (%) | | 45.6 | 51.3 | 60.1 | 49.9 | 53.1 | 48.5 | 45.0 | 45.0 | 35.6 | 50.2 | 55.5 |
| Washing degree of the soiled cotton clothes (%) | | 52.8 | 55.1 | 55.5 | 55.1 | 57.1 | 54.3 | 53.6 | 53.7 | 50.1 | 50.2 | 50.1 |

Notes:
Soil release agents
Compound 1: The crosslinked product obtained in Production Example 1
Compound 2: The crosslinked product obtained in Production Example 2
Compound 3: The crosslinked product obtained in Production Example 3
Compound 4: The crosslinked product obtained in Production Example 4
Compound 5: The crosslinked product obtained in Production Example 5
Compound 6: The crosslinked product obtained in Production Example 6
Compound 7: Repel-O-Tex SRP-4 manufactured by Rhodia
Surfactants
LAS: Sodium long-chain alkyl ($C_{12}$) benzene sulfonate
AE: Polyoxyethylene (6 moles) alkyl ($C_{12}$) ether
Polycarboxylic acid-based polymer compounds
Na polyacrylate: average molecular weight 10,000
AM: A sodium salt of acrylic acid/maleic acid (molar ratio 7/3), average molecular weight 70,000
PEG: Polyethylene glycol (average molecular weight 1000)
Other components
Zeolite: Crystalline aluminosilicate, $M_2O \cdot Al_2O_3 \cdot 2SiO_2 \cdot 2H_2O$, an average particle diameter of 2 μm, an ion exchange capacity of 290 $CaCO_3$ mg/g.
Fluorescent component: A blend of Tinopal CBS-X and Tinopal AMS-GX (manufactured by Ciba S.C.) in a ratio of 1:1.
Enzyme component: A mixture of Sabinase 12.0 Type W (manufactured by Novozyme), KAC-500G (manufactured by Kao Corporation), Termamil 60T (manufactured by Novozyme) in a ratio of 2:1:1.

The invention claimed is:

1. A detergent composition comprising a detergent and a crosslinked product, wherein said crosslinked product is obtained by reacting a compound having 2 to 32 hydroxyl groups referred to as component (a) with a polyhydric alcohol polyglycidyl ether referred to as component (b), wherein the component (a) is a compound represented by the formula (II):

$$HO—R^2—NX—R^3—OH \quad (II)$$

wherein $R^2$ and $R^3$ independently represent a C2 to C3 alkylene group, X represents a hydrogen atom or a group represented by $—R^4—OH$ whereupon $R^4$ represents a C2 to C3 alkylene group, and $R^2$, $R^3$ and $R^4$ may contain repeated oxyethylene groups and/or oxypropylene groups, and wherein the polyhydric alcohol group of component (b) is a compound represented by the formula (III):

$$HO—(R^5O)_n—H \quad (III)$$

wherein $R^5$ represents a C2 to C3 alkylene group, and n is a number of 1 to 30; glycerin; polyglycerin having a polymerization degree of 2 to 30; or sorbitol.

2. The detergent composition according to claim 1, wherein the component (a) is triethanolamine and the component (b) is a diglycidyl ether of either ethylene glycol or polyethylene glycol.

3. The detergent composition according to claim 1, wherein X of formula (II) represents $—R^4—OH$.

4. A method of releasing soil from clothes, comprising the step of: washing said clothes with the crosslinked product described in claim 1.

* * * * *